US005253395A

United States Patent [19]

Yano

[11] Patent Number: 5,253,395

[45] Date of Patent: Oct. 19, 1993

[54] WATERTIGHT SLIDE FASTENER

[75] Inventor: Humihiro Yano, Toyama, Japan

[73] Assignee: Yoshida Kogyo K. K., Tokyo, Japan

[21] Appl. No.: 904,568

[22] Filed: Jun. 26, 1992

[51] Int. Cl.[5] ..... A44B 19/32

[52] U.S. Cl. ..... 24/387; 24/389

[58] Field of Search ..... 24/384, 387, 389, 390, 24/435, 436, 418

[56] References Cited

U.S. PATENT DOCUMENTS 3,759,073 9/1973 Rifkin ..... 24/387 X
3,990,130 11/1976 Hattori ..... 24/384
4,524,493 6/1985 Imamura ..... 24/389
4,604,775 8/1986 Kusagama ..... 24/389
4,825,514 5/1989 Akeno ..... 24/389
5,161,286 11/1992 Herrington, Jr. et al. ..... 24/387

*Primary Examiner*—James R. Brittain
*Attorney, Agent, or Firm*—Hill, Steadman & Simpson

[57] ABSTRACT

In a watertight slide fastener, a slider has a first locking arrangement on an outer surface of a slider body, and a seal portion of a top stop for tightly fitting with the slider has a second locking arrangement engageable with the first locking arrangement.

3 Claims, 6 Drawing Sheets

WATERTIGHT SLIDE FASTENER

BACKGROUND OF THE INVENTION

1. Field of the Invention

This invention relates to a watertight slide fastener for a wet suit, a waterproof bag or other articles needed to be watertight and airtight.

2. Description of the Related Art

This type of watertight slide fastener is currently known in which a U-shape top stop for receiving a slider body when the slide fastener is closed is mounted on a surface of a slide fastener chain (Japanese Patent Publication No. 22686/1970). Another watertight slide fastener of the described type is known in which a top stop is composed of an inner seal portion for being fitted in an opening between upper and lower wings of a slider body and an outer seal portion for tightly closing the opening, the outer seal portion having a pair of arcuate projections extending inwardly from opposite ends of the outer seal portion for contacting opposite side walls of guide flanges of the slider body (Japanese Utility Model Laid-Open Publication No. 103411/1988).

In the first-named prior watertight slide fastener, the slider itself has an ordinary shape rather than a unique shape, and the U-shape top stop for merely receiving the slider body is mounted on the top end of the slide fastener chain. Partly since the slider body is merely engageable with the top stop and partly since such engagement takes place only at the surface of the fastener chain, the slider body tends to be inclined or move when an external force is exerted on the surface of the slider body, so that the slide fastener cannot be closed with perfect watertightness.

Also in the second-named prior watertight slide fastener, in which the slider itself has a very ordinary type, partly since the guide flanges of the slider body are merely engageable with the arcuate projections of the opposite end of the outer seal portion and partly since there is no locking and retaining means between the slider body and the top stop, the slider tends to move so that the slide fastener cannot be closed with perfect watertightness. Additionally since only the opening between the upper and lower wings of the slider body is to be closed, only an inadequate degree of watertightness can be achieved.

SUMMARY OF THE INVENTION

With the foregoing prior problems in view, it is an object of this invention to provide a watertight and airtight slide fastener which has a means for locking and retaining a slider in position on a top stop so that the slider cannot be moved unless it is done intentionally.

According to a first aspect of the invention, there is provided a watertight slide fastener wherein a slider has first locking means on an outer surface of a slider body, and a seal portion of a top stop for tightly fitting with the slider has second locking means engageable with the first locking means.

Preferably the first locking means is a pair of projections extending outwardly in opposite directions from a guide flange of the slider body, and the second locking means is a pair of recesses in confronting inner surfaces of the seal portion of the top stop for receiving the respective projections. Further the slider has upper and lower wings disposed on upper and lower surfaces, respectively, of the slider body and projecting forwardly beyond a diamond of the slider body, and the top stop has upper and lower grooves extending in and along an inner surface of the top stop for receiving the upper and lower wings, respectively.

In operation, when the slider body is brought against the top stop as the slide fastener chain is closed by pulling the slider along the slide fastener chain, the first locking means on the guide flanges of the slider body will come into engagement with the second locking means on the seal portion of the top stop to prevent the slider from moving. By this closing operation, the projected edges of the upper and lower wings on the slider body are inserted and fitted into the upper and lower grooves in the seal portion of the top stop so that the slider and top stop are interengaged with reliableness. For opening the slide fastener chain, the slider is moved on and along the slide fastener chain so as to disengage the first locking means on the slider body from the second locking means on the top stop.

DETAILED DESCRIPTION

Watertight slide fasteners embodying this invention will now be described in detail with reference to the accompanying drawings.

Figure 1:
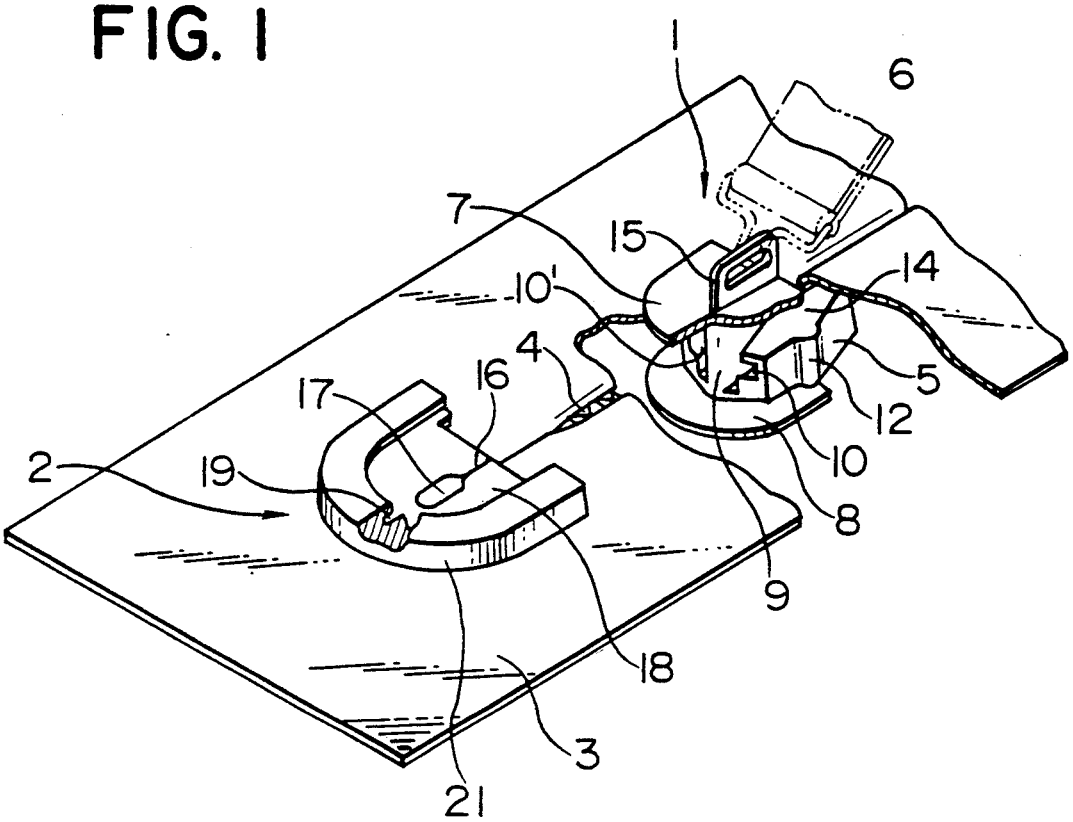
FIG. 1 is a fragmentary perspective view showing the front side of a conceal-type watertight slide fastener of this invention in an open position.
Figure 2:
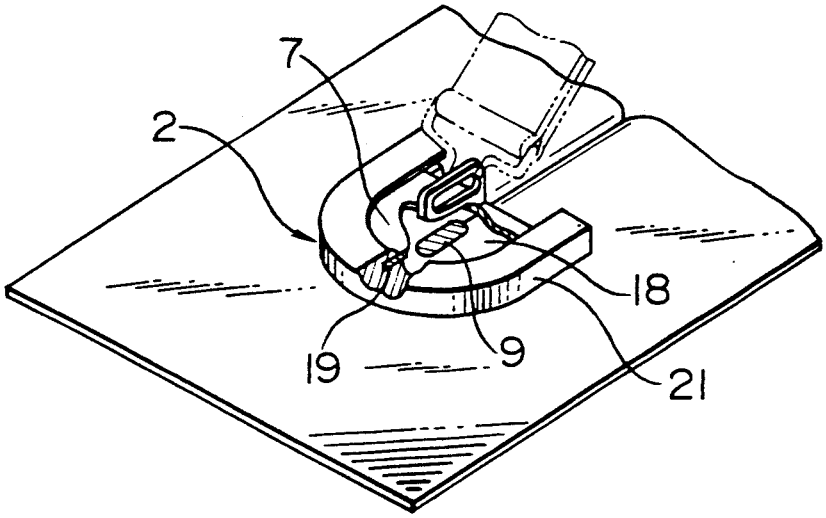
FIG. 2 is a fragmentary perspective view showing the front side of the conceal-type watertight slide fastener in a closed position.
Figure 3:
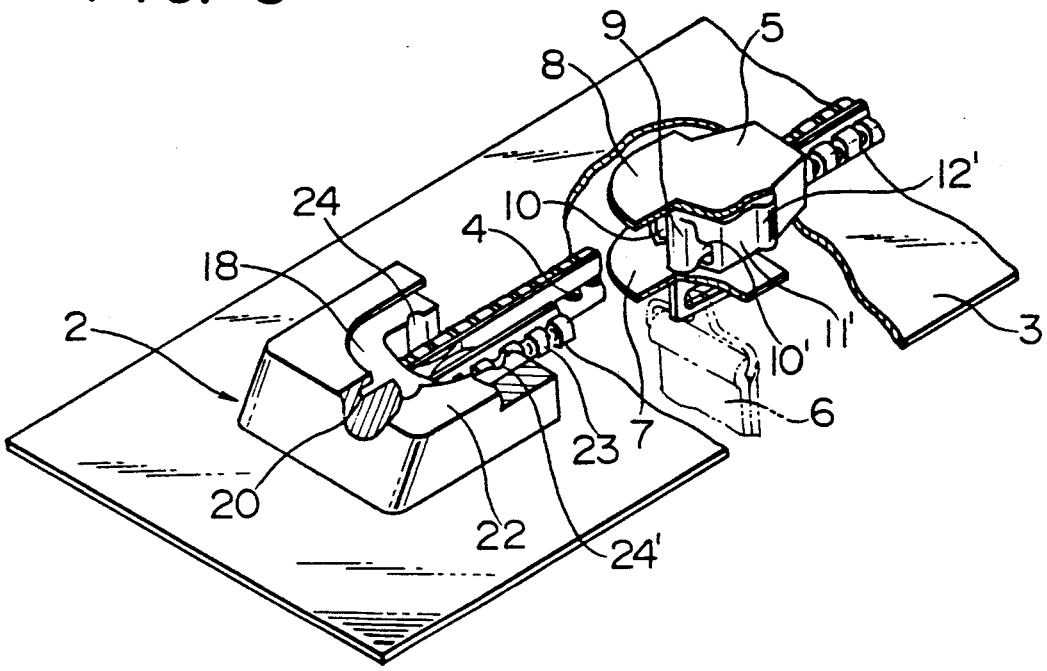
FIG. 3 is a fragmentary perspective view showing the rear side of the conceal-type watertight slide fastener in an open position.
Figure 4:
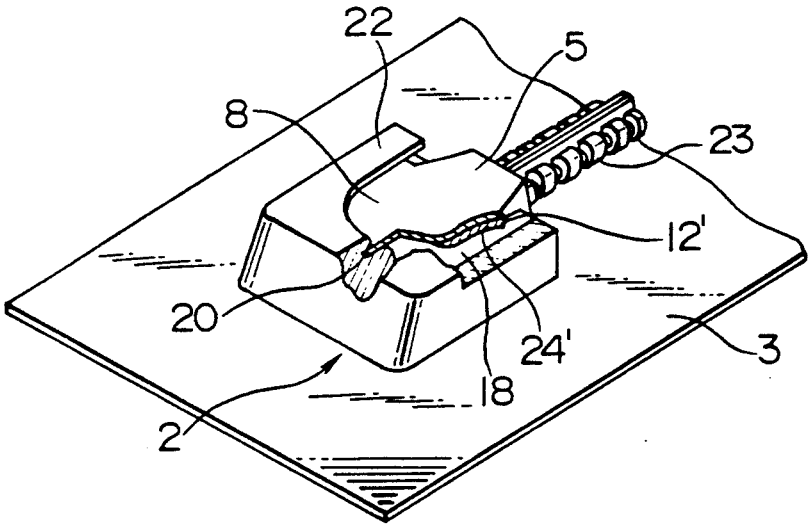
FIG. 4 is a fragmentary perspective view showing the rear side of the conceal-type watertight slide fastener in a closed position.
Figure 5:
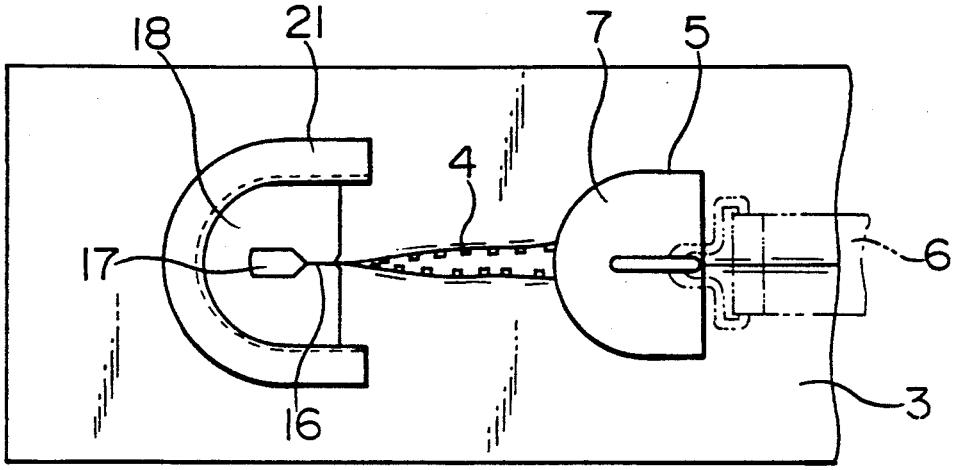
FIG. 5 is a fragmentary plan view showing the conceal-type watertight slide fastener in an open position.
Figure 6:
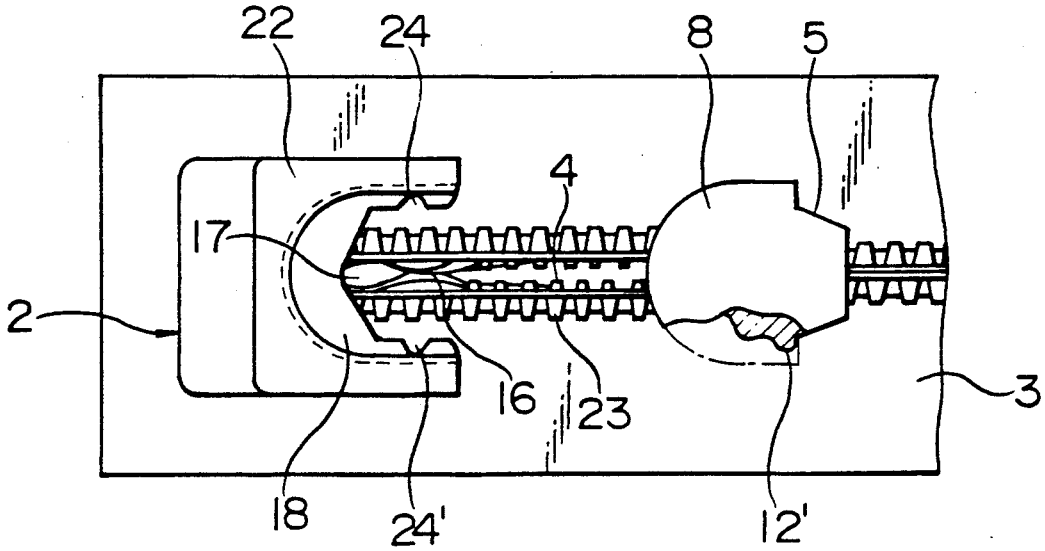
FIG. 6 is a fragmentary bottom view showing the conceal-type watertight slide fastener in an open position.
Figure 7:
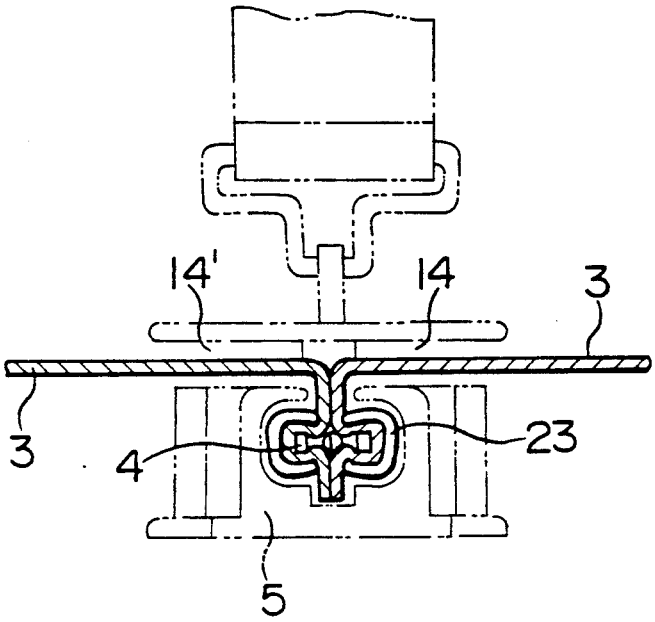
FIG. 7 is a transverse cross-sectional view showing the conceal-type watertight slide fastener in a closed position.
Figure 8:
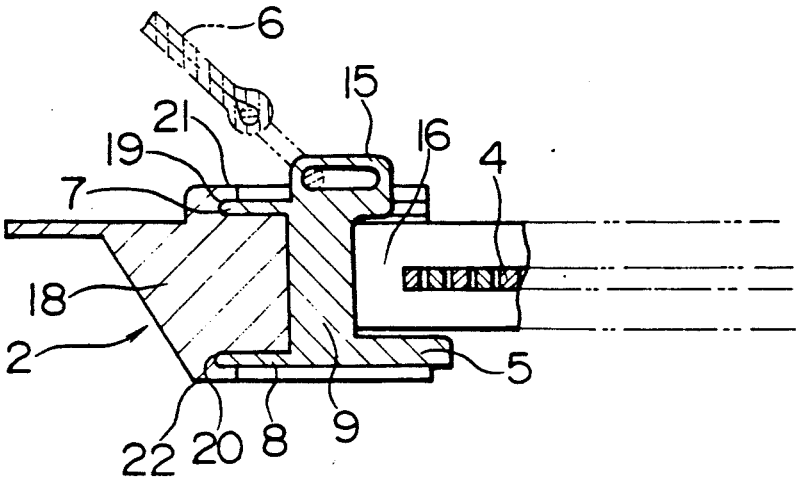
FIG. 8 is a fragmentary longitudinal cross-sectional view showing the conceal-type watertight slide fastener in a closed position.
Figure 9:
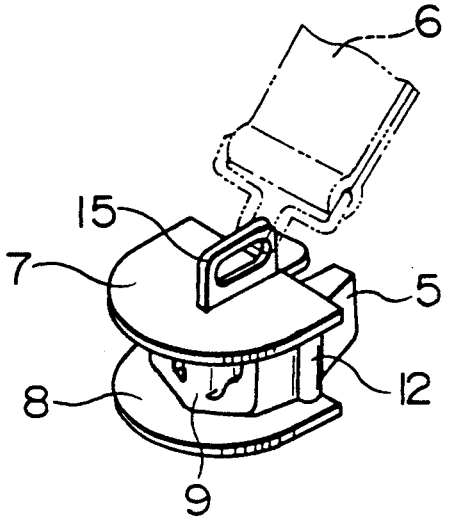
FIG. 9 is a perspective view of a slider for the conceal-type watertight slide fastener.
Figure 10:
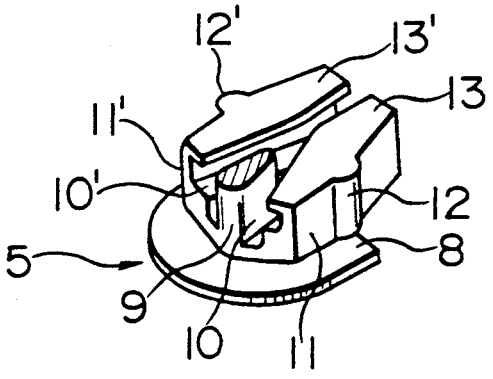
FIG. 10 is a perspective view, with parts broken away, of the slider for the conceal-type watertight slide fastener.

The watertight slide fastener shown in FIGS. 1 through 10 is a so-called conceal-type watertight slide fastener. This conceal-type watertight slide fastener generally comprises a slider 1, a top stop 2, a waterproof tape 3, and a pair of rows of coupling elements 4. The slider 1, as shown in FIGS. 9 and 10, includes a slider body 5 and a pull tab 6. The slider body 5 has on its upper and lower surfaces upper and lower wings 7, 8 connected by a diamond 9 and having respective front ends extending forwardly beyond the diamond 9. The slider body 5 also has a pair of guide flanges 11, 11' projecting from the opposite edges of the lower wing 8 so as to define on the opposite sides of the diamond 9 a pair of guide channels 10, 10' for guiding therealong the pair of rows of coupling elements 4. The guide flanges 11, 11' have on their respective outer surfaces a pair of vertical locking projections 12, 12'. The guide flanges 11, 11' also have a pair of inwardly directed flanges 13, 13' extending from the respective upper edge of the guide flanges 11, 11'. A pair of tape guide channel portions 14, 14' for passage of the waterproof tape 3 is defined between the upper wing 7 and the inwardly directed flanges 13, 13'. An attachment ring 15 of the pull tab 6 is mounted on the upper surface of the upper wing 7.

The top stop 2, as shown in FIGS. 1, 3, 5, 6 and 8, is formed at one ends of opposite opening edges of the waterproof tape 3, to and along which opening edges the pair of rows of coupling elements 4 are attached. The top stop 2 is formed integrally with the waterproof tape 3, using the same material. The top stop 2 includes an inner seal portion 18 having at its bottom side a passageway 16 which is to be fitted in the tape guide channel portions 14, 14' of the slider body 5 and through which the diamond 9 is to pass and with which the opposite opening edges of the water-proof tape are engageable after the diamond 9 has passed the passageway 16, and at its forward side of the passageway 16 an engaging bay 17 for surrounding and tightly engaging the diamond 9 as shown in FIG. 8. The top stop 2 also includes generally U-shape upper and lower outer seal portions 21, 22 formed integrally with the inner seal portion 18. The upper and lower outer seal portions 21, 22 have in their respective inner surfaces upper and lower grooves 19, 20 for receiving and holding the respective projected edges of the upper and lower wings 7, 8. The inner seal portion 17 has in its inner confronting surfaces a pair of vertical locking recesses 24, 24' engageable with the respective locking projections 12, 12' on the outer surfaces of the guide flanges 11, 11'. When the slider 1 is brought against the top stop 2, the locking projections 12, 12' will comes into engagement with the locking recesses 24, 24' to prevent the slider from being removed from the top stop 2.

The slide fastener chain includes a waterproof tape 3, such as of soft synthetic resin film or rubber-reinforced fabric, and a pair of rows of coupling elements 4 attached on and along a pair of opposite opening edges of the waterproof tape 3. In production, as shown in FIG. 7, the base of the individual coupling element 4 is surrounded by the waterproof tape 3 and then is clamped by a clamp member 23 from the outer surface of the waterproof tape 3.

Figure 11:
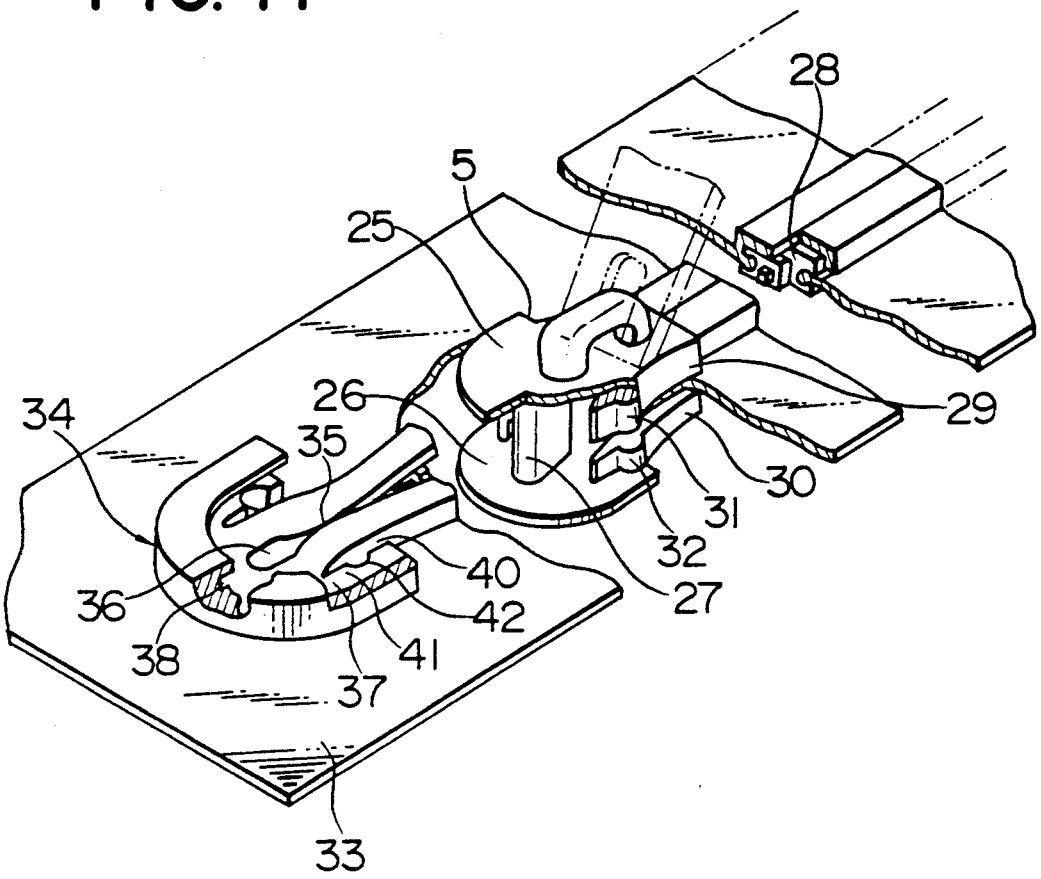
FIG. 11 is a fragmentary perspective view showing an ordinary-type watertight slide fastener in an open position.
Figure 12:
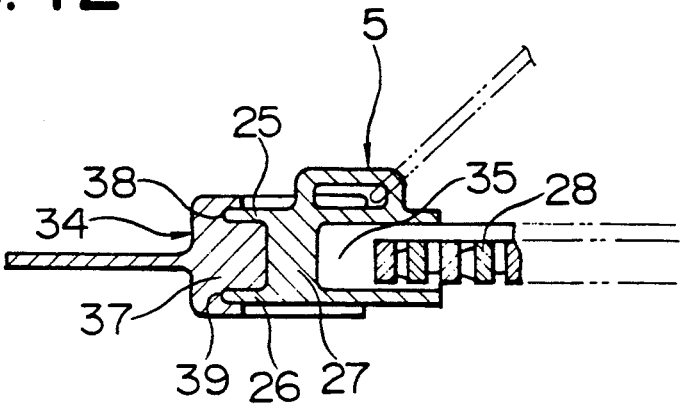
FIG. 12 is a fragmentary longitudinal cross-sectional view showing the ordinary-type watertight slide fastener in a closed position.

FIGS. 11 and 12 show an ordinary-type watertight slide fastener according to another embodiment of this invention. In this watertight slide fastener, the slider body 5 has on its upper and lower surfaces upper and lower wings 25, 26 connected by a diamond 27 and having respective front ends extending forwardly beyond the diamond 27. The slider body 5 also has a pair of upper guide flanges 29 projecting from the opposite edges of the upper wing 25 and a pair of lower guide flanges 30 projecting from the opposite edges of the lower wing 26 for guiding therealong the pair of rows of coupling elements 28. The upper and lower guide flanges 29, 30 have on their respective outer surfaces a pair of vertical locking projections 31, 32.

The slide fastener chain includes a waterproof tape 33 and a pair of rows of coupling elements 28 attached to a pair of confronting opening edges of the waterproof tape 33 covering upper and side surfaces of the coupling elements 28 so as to form a pair of ridges. A top stop 34 is formed at one element-free ends of the ridges integrally therewith as extensions thereof. The top stop 34 has a passageway 35 through which the diamond 27 is to pass and with which the opposite opening edges of the waterproof tape 33 are engageable after the diamond 27 has passed the passageway 35, and at its forward side of the passageway 35 an engaging bay 36 for surrounding and tightly engaging the diamond 27. The top stop 34 also has a generally U-shape seal portion 37 having in their respective inner surfaces upper and lower grooves 38, 39 for receiving and holding the respective projected edges of the upper and lower wings 25, 26. The seal portion 37 also has, in its inner confronting surfaces 41 defining with the ridges a pair of openings 40 receptive of the guide flanges 29, 30, a pair of vertical locking recesses 42, 42 engageable with the respective locking projections 31, 32 on the outer surfaces of the upper and lower guide flanges 29, 30. When the slider is brought against the top stop 34, the locking projections 31, 32 will comes into engagement with the locking recesses 42, 42 to prevent the slider from being removed from the top stop 34.

In each of the first and second embodiments, the locking projections 12, 12' or 31, 32 may be formed on the top stop 2 or 34, and the locking recesses 24, 24' or 42, 42 may be formed in the guide flanges 11, 11' or 29, 30 of the slider. The significant feature of this invention is that there is provided a means for locking the slider with the top stop, the means requiring no particular form. Further, in the second embodiment, the locking means may be located between the upper guide flanges 29 of the slider and the seal portion 37 of the top stop 34.

With the watertight slide fastener of this invention, since one of interlockable first and second locking means is formed on the outer surface of the slider body while the other is formed on the seal portion of the top stop in which the slider body is to be tightly fitted, the slider is prevented from being moved off the top stop due to a relatively large amount of external force exerted on the slider after the first and second locking means have come into engagement with one another. In the watertight slide fastener of this invention, unlike the prior watertight slide fastener of one type in which the slider and the top stop are merely interengageable and the prior watertight slide fastener of another type in which the top stop for holding the slider body is located on only one surface of the slide fastener chain, since the slider locking and retaining means works reliably, it is possible to improve the degree of watertightness of the slide fastener.

Further, since the projected edges of the upper and lower wings on the upper and lower surface of the slider body can be inserted and held in the upper and lower grooves in the seal portion of the top stop, the slider is prevented from any movement due to the external force exerted on the slider, irrespective of the direction of external force, so that perfect watertightness and airtightness can be secured, thus realizing a very useful watertight slide fastener.

What is claimed is:

1. A watertight slide fastener wherein a slider has a first locking means on an outer surface of a slider body, and a seal portion of a top stop for tightly fitting with said slider has second locking means engageable with said first locking means;

wherein said first locking means is a pair of projections extending outwardly in opposite directions from a guide flange of said slider body, and said second locking means is a pair of recesses in confronting inner surfaces of said seal portion of said top stop for receiving the respective projections.

2. A watertight slide fastener according to claim 1, wherein said slider has upper and lower wings disposed on upper and lower surfaces, respectively, of said slider body and projecting forwardly beyond a diamond of said slider body, and said top stop has upper and lower grooves extending in and along an inner surface of said top stop for receiving said upper and lower wings, respectively.

3. A watertight slide fastener wherein a slider has first locking means on an outer surface of a slider body, and a seal portion of a top stop for tightly fitting with said slider has second locking means engageable with said first locking means;

wherein said slider has upper and lower wings disposed on upper and lower surfaces, respectively, of said slider body and projecting forwardly beyond a diamond of said slider body, and said top stop has upper and lower grooves extending in and along an inner surface of said top stop for receiving said upper and lower wings, respectively.

* * * * *